US006484479B1

(12) United States Patent
Minion

(10) Patent No.: US 6,484,479 B1
(45) Date of Patent: Nov. 26, 2002

(54) FORM, FILL AND SEAL APPARATUS WITH CAVITY BAR

(75) Inventor: Craig A. Minion, Excelsior, MN (US)

(73) Assignee: Tetra Laval Holdings & Finance, SA, Pully (CH)

( * ) Notice: Subject to any disclaimer, the term of this patent is extended or adjusted under 35 U.S.C. 154(b) by 0 days.

(21) Appl. No.: 09/546,072

(22) Filed: Apr. 10, 2000

(51) Int. Cl.[7] ..... B65B 43/32
(52) U.S. Cl. ..... 53/565; 53/579; 53/282
(58) Field of Search ..... 53/282, 565, 579, 53/377.6

(56) References Cited

U.S. PATENT DOCUMENTS 2,750,721 A * 6/1956 Earp et al. ..... 53/282
2,932,142 A * 4/1960 Sindzinski ..... 53/386.1
2,938,314 A * 5/1960 Hopkins ..... 53/386.1
3,280,531 A * 10/1966 Jagenberg ..... 53/565
3,579,958 A * 5/1971 Hentges ..... 53/565
3,877,354 A * 4/1975 Schmermund ..... 53/579
4,614,079 A * 9/1986 Ida et al. ..... 53/579
4,753,060 A * 6/1988 Furukawa ..... 53/579
4,845,927 A * 7/1989 Rapparini ..... 53/512
5,488,812 A * 2/1996 Stark ..... 53/565
5,678,388 A * 10/1997 Weder ..... 53/579

* cited by examiner

*Primary Examiner*—John Sipos
(74) *Attorney, Agent, or Firm*—Welsh & Katz, Ltd.

(57) ABSTRACT

A form, fill and seal packaging machine is adapted to receive a carton blank, erect the carton blank into an open-top carton, fill and seal the open-top carton. The cartons have a predetermined cross-sectional shape and size. The packaging machine includes a frame, a plurality of stations carried by the frame including a carton erection station, a bottom flap sealing station, a filling station and a top flap sealing station, and a drive assembly. A conveying assembly is operably connected to the drive assembly for moving the cartons through the stations. A plurality of cavity bars are carried by the conveying assembly. Each of the cavity bars defines cavities formed therein that correspond generally to the cross-sectional size and shape of the cartons. Each of the cavities is defined by internal peripheral surfaces configured for receiving and securing the carton therein as the carton is conveyed between the stations of the machine.

37 Claims, 3 Drawing Sheets

FORM, FILL AND SEAL APPARATUS WITH CAVITY BAR

FIELD OF THE INVENTION

This invention pertains to a form, fill and seal machine for packaging flowable product. More particularly, the invention relates to a form, fill and seal machine for packaging flowable product, such as liquid food, that utilizes a cavity in which the packages are supported and transported packages through the machine.

BACKGROUND OF THE INVENTION

Paperboard-based containers are in widespread use for the packaging of, for example, liquid food products. Examples of liquid food products that can be packaged in paperboard containers include milk, juice and the like. Such containers are also used for packaging other flowable products, such as soups that can be in a powdered or liquid form with or without particulate matter.

In conventional form, fill and seal machines, a plurality of carton blanks are stored in a flat form in a magazine. The blanks are dispensed to a carton forming station where the cartons are erected, bottom sealed, filled and top sealed. In this process, the cartons can also be sterilized, for example, after bottom sealing, prior to filling. The cartons are conveyed in an indexed manner through the various stations and subsequently discharged from the machine at an off-loading station. Generally, the cartons are conveyed through the machine by a belt or like conveying device. The cartons are supported from their respective bottoms which rest on a low friction, stationary table top-like portion of the machine associated with the conveyor.

At the carton forming station, individual carton blanks are erected and subsequently placed on one of a plurality of mandrels that is positioned on a rotating, indexed hub. At a first station, the cartons are erected and placed on the mandrel. The mandrel hub or wheel is rotated to subsequent stations to pre-fold the bottom panels, heat the panels and the seal the panels to one another to form the sealed carton bottom. The cartons are then ejected from the mandrel onto the conveyor portion of the machine for subsequent sterilization, filling and top sealing. The hubs typically include from four to six mandrels.

The mandrels provide a form around which the carton is folded and sealed. As such, each mandrel includes an elongated body that is fully fitted within the interior of the erected or semi-erected carton. The mandrel is configured so that the carton side panels rest on the sides of the mandrel and the carton bottom panels are folded around a corresponding "bottom" portion of the mandrel which provides structure for carton formation. The mandrel is further configured to assure that the panels fold at the score lines. In this manner, the panels are properly folded along the score lines without inadvertent collapse of adjacent portions of carton panels, e.g., collapse of adjacent side panels.

Although such mandrel-type carton forming stations work well for their intended purpose or purposes, there may well be some drawbacks when used in certain arrangements. First, these mandrel-type arrangements can be quite costly to manufacture. To promote the standards necessary in such a highly sanitary environment, the mandrels are formed from stainless steel. Often, the material used to form the mandrel is an unconventional or even exotic steel material to minimize to the greatest extent possible and even eliminate the potential for corrosion of the machine parts and contamination of the product. In addition, these parts are necessarily highly machined components, again adding to the overall cost of the packaging machine.

Second, because of the nature of the mandrel arrangement, a particular operation can be carried out only one carton at a time. That is, only one carton can have its bottom flaps in-folded, while one different carton can have its bottom flaps heated, while still one other carton can have its bottom flaps sealed. The result is that only one carton can be operated on (e.g., erected, prefolded and/or folded, heated or sealed) at a given station at a given time. This can, of course, be increased through the use of multiple mandrels and higher machine operating speeds, however, at increased cost.

In addition, during carton formation, the mandrel is disposed within the interior of the carton as the carton moves along and through the various steps at the carton forming station. That is, the mandrel remains within the interior portion of the carton as the bottom flaps are in-folded and sealed to one another. As a result, the time duration that could otherwise be used for carrying out functions on the interior portion of the carton are subsumed by that period of time during which the mandrel is positioned within the carton interior. To this end, it would otherwise be desirable to reduce or eliminate the time during which the mandrel is disposed within the carton interior so that that time period can be used for, for example, additional carton sterilization.

In addition, it has been observed that in order to economically package these food and other products, a minimum machine "throughput" must be maintained. That is, the machine must be operated at a speed necessary to assure that a minimum number of packages are processed or filled in any given average period of time. This minimum throughput has increased, necessitating increased machine operating speeds and efficiency, again adding to the overall cost of the form, fill and seal packaging machine.

Accordingly, there exists a need for a high speed form, fill and seal packaging machine that minimally contacts the inside surfaces of a carton formed, filled and sealed therein. Desirably, such a packaging machine permits forming, filling and sealing multiple cartons at a time, at a throughput at least as great as known machines, and most desirably, at a slower machine operating speed.

SUMMARY OF THE INVENTION

A form, fill and seal packaging machine is adapted to receive a carton blank, erect the carton blank into an open-top carton, fill and seal the open-top carton. The cartons each have a predetermined cross-sectional shape and size.

The machine includes a frame, a plurality of stations carried by the frame including a carton erection station, a bottom flap sealing station, a filling station and a top flap sealing station, and a drive assembly. A conveying assembly is operably connected to the drive assembly for moving the cartons through the stations.

A plurality of cavity bars are carried by the conveying assembly. Each of the cavity bars defines at least one cavity formed therein corresponding generally to the cross-sectional size and shape of the cartons. Each of the cavities is defined by internal peripheral surfaces. Preferably, each of the cavity surfaces has a plurality of vacuum openings formed therein. The cavity bars are adapted to engage a carton disposed in the cavity and can secure the carton to the internal peripheral walls. In a preferred embodiment the cartons are secured to the internal peripheral walls by application of a vacuum through the vacuum openings.

Preferably, the vacuum is applied to the cartons at at least one of the stations to secure the carton within the cavity. In a current embodiment, the machine includes a top flap pre-folding station and a bottom flap pre-folding -station, and the vacuum is applied at at least the top flap and bottom flap pre-folding stations.

Preferably, the cavity bar is formed having channels formed in upper and lower surfaces thereof, and the cavity bar includes upper and lower collar portions fitted within a respective each of the channels. The collar portions can define a vacuum channel for communicating the vacuum from a vacuum source to the carton. The vacuum channels can include peripheral portions and a plurality of vacuum legs extending from the peripheral portions to openings in the collar portions. The cavity bars can be configured having a body having the channels formed therein and openings or dimples in the body corresponding to the openings in the collar portion.

Most preferably, the upper collar portions each include a vacuum port formed therein for communicating the vacuum from the vacuum source to the upper collar vacuum openings. A bore in the cavity bar body provides for communicating the vacuum to the lower collar portion. In a most preferred embodiment, each of the cavities includes an open area formed in each of the corners, traversing through the upper collar, the cavity bar body and the lower collar. The open corners are configured to allow expansion or mild deformation of the cartons as the vacuum is applied to the cartons, and also facilitates ready initial insertion of the cartons into the cavities.

In a presently preferred embodiment, the form, fill and seal packaging machine conveying assembly has a predetermined path having an upper, generally horizontal path portion and a lower path portion, and wherein the lower path portion is spaced from the upper path portion. The conveying assembly is configured having a generally vertical path portion such that a partially-formed carton is urged into the cavity as the cavity bar traverses along the generally vertical path portion.

These and other features and advantages of the present invention will be apparent from the following detailed description, the accompanying drawings, and the appended claims.

DETAILED DESCRIPTION OF THE PREFERRED EMBODIMENTS

Figure 1:
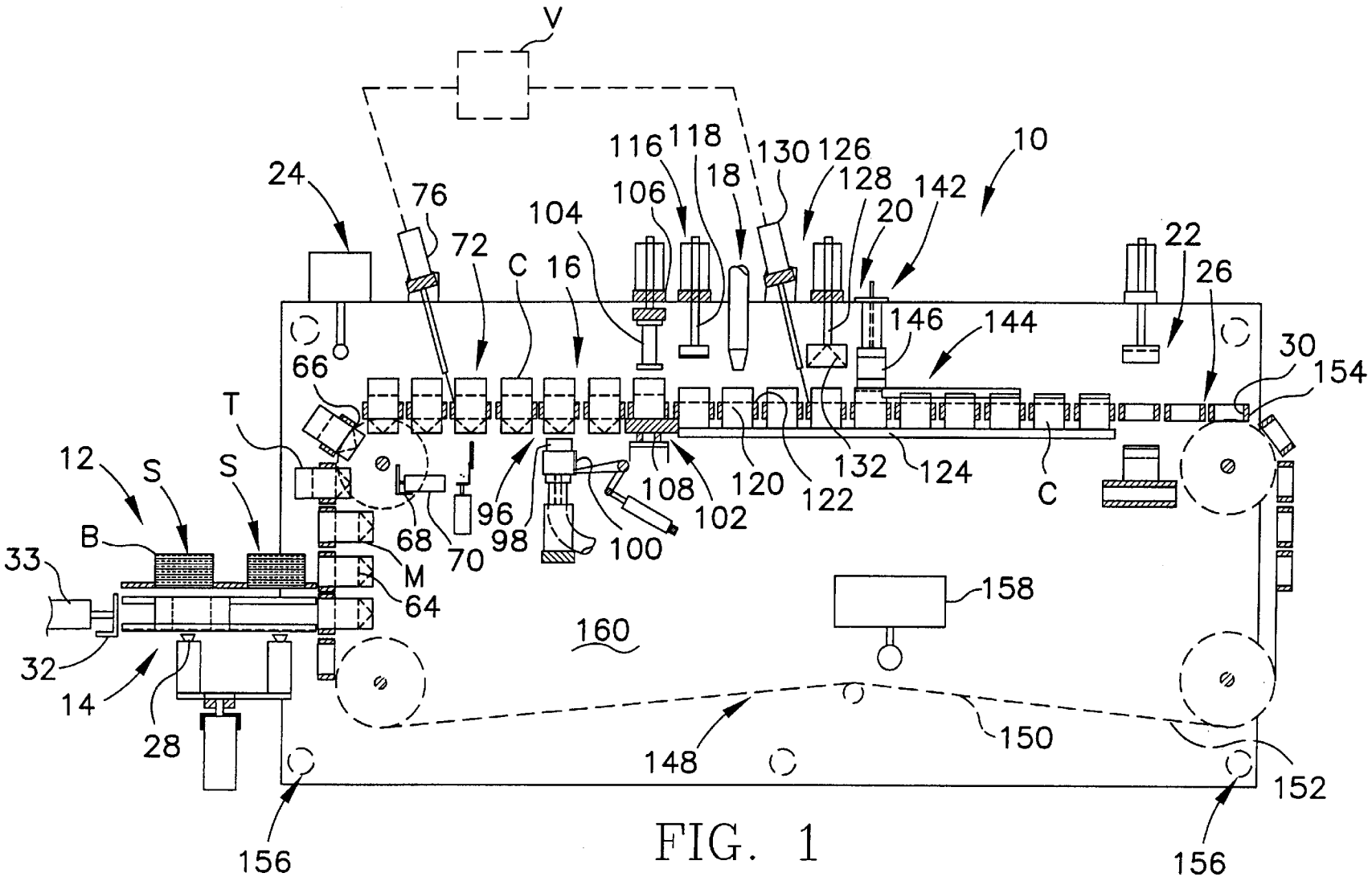
FIG. 1 schematic side view of a form, fill and seal machine in accordance with the principles of the present invention, the illustrated machine having a plurality of cavity bars for externally supporting and conveying cartons therethrough.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a form, fill and seal packaging machine indicated generally at 10, that embodies the principles of the present invention. As with all form, fill and seal packaging machines, the present machine 10 includes a plurality of stations including, among others, a carton blank B magazine 12, a carton erection station 14, a bottom sealing station 16, a filling station 18, a top sealing station 20, and an off-loading or discharge station 22. Optionally, the machine 10 can include one or more sterilization stations 24 for sterilizing the cartons C, for example, prior to filling.

Cartons C are conveyed among the several stations 14–24 by a cavity bar 26, the details of which will be provided in detail below. The cartons C are provided into the magazine 12 in a blank B form. That it, the cartons C are cut and scored and have respective, adjacent side seals formed. The blanks B, in a flat, folded form are taken from the magazine 12 and are erected into a tubular form at the carton erection station 14, which includes a plurality of vacuum cups 28. The vacuum cups 28 engage one or more sides of the blank B (i.e., one or more side panels) and urge the blank B into the tubular, carton C form. Apparatus and methods for erection of the cartons C into the tubular form will be recognized those skilled in the art.

The cartons C, now in the tubular form, are pushed or urged into openings 30 in the cavity bar 26 by a pusher bar 32. The pusher bar 32 can be actuated by any of known actuation means such as a pneumatic cylinder 33, electromechanical cylinder or the like. The cavity bar 26 moves through the several stations 14–24 in an indexed manner so as to convey the cartons C through the machine 10. The tubular formed cartons C, which, when positioned in the cavity bar 26, have open top T and bottom M ends or panels, are secured into cavities 34 in the cavity bar 26. In a preferred embodiment, the cartons C are secured within the cavities 34 by the application of a vacuum which will also be described in more detail herein.

Figure 2:
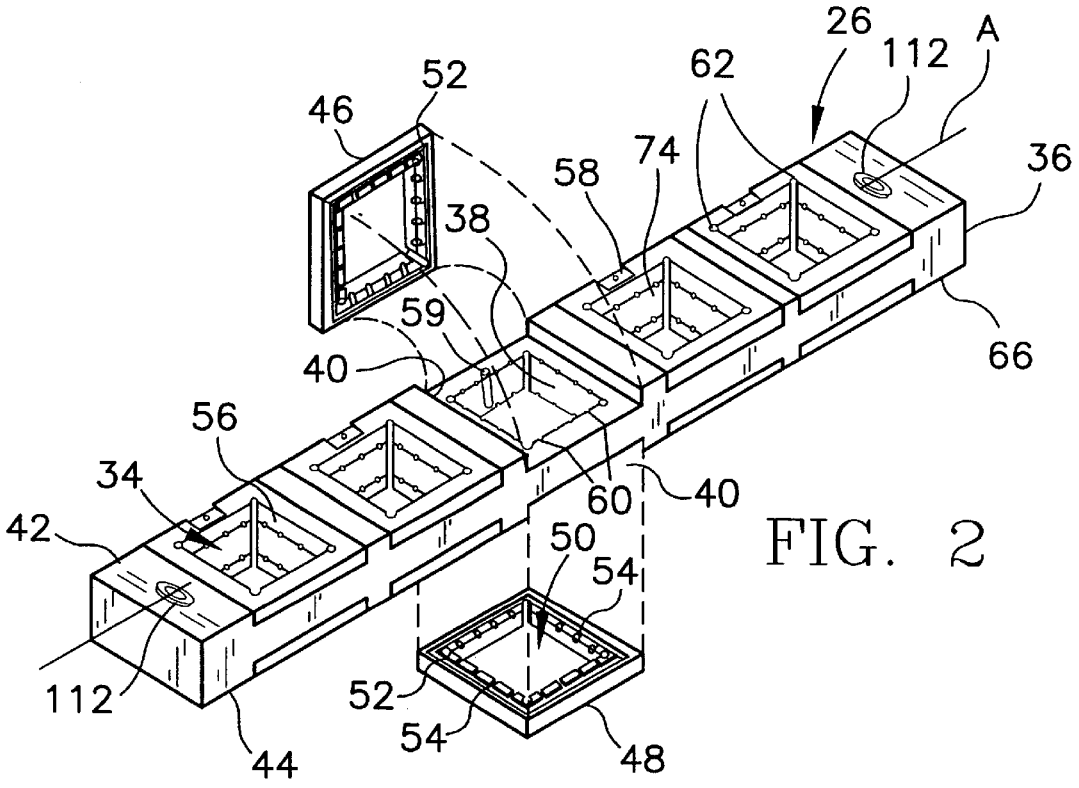
FIG. 2 is a partial perspective view of a cavity bar embodying the principles of the present invention, the upper and lower collars of one of the cavities being shown in a partially exploded view for clarity of illustration.

Referring to FIG. 2, in a preferred embodiment, each cavity bar 26 includes a plurality of cavities 34. Each cavity 34 is configured to receive a singulated, erected, tubular carton C. In a current embodiment, the cavity bar 26 is configured with five cavities 34 therein and each cavity 34 is configured to receive a singulated carton C. As such, the carton magazine 12 is configured having five individual "stacks" S of blanks B, each stack S feeding a series of cavities 34.

The exemplary cavity bar 26 illustrated in FIG. 2 includes a support bar 36 that defines a plurality of generally rectangular cavities 38 extending through the support bar 36. Channels 40 are formed in the support bar 36, extending generally transversely to a longitudinal axis A of the support bar 36, and extending across the cavities 38. The channels 40 are formed, as shown in FIG. 2, along upper and lower surfaces 42, 44 of the support bar 36. In a preferred embodiment, the cartons C are secured within the cavities 34 by application of a vacuum. To this end, an insert or vacuum collar 46, 48 is fitted into each of the channels 40 and includes an opening 50 formed therein that is sized accordingly to mate with the cavities 38 formed in the support bar 36. When constructed, a carton C is disposed within the cavity 34, through the upper vacuum collar 46, the support bar cavity 38, and the lower vacuum collar 48.

The upper and lower vacuum collars 46, 48 each include a peripheral vacuum channel 52 and a plurality of inwardly extending vacuum legs 54 extending from the peripheral channel 52 to the cavity 34. The vacuum legs 54 are each open to the inner surfaces 56 of the collars 46, 48 that define a portion of the cavity 34. An upper vacuum port 58 extends from the upper surface of the upper collar 46, through the body of the collar, into the peripheral channel 52. A bore 59 extends through the support bar 36 to provide for communicating the vacuum to the lower collar peripheral channel 52.

The support bar 36 includes dimples 60 that mate and cooperate with the vacuum legs 54 of the upper and lower collars 46, 48. The dimples 60, along with the vacuum legs 54 provide an area over which a vacuum is applied to the sides of the carton C to "draw" the carton C against the internal walls or inner surfaces 74 of the cavity 34 within the support bar 36. Each of the cavities 34 defines an open comer portion or area, as indicated at 62, that extends through the upper collar 46, the support bar 36 and the lower collar 48. The open comers 62 permit expansion of the carton C at the corners, such as that that may occur when vacuum is applied to the side panels of the carton C. The open comers 62 further facilitate easy fit of the carton C into the cavities 34 upon initial insertion of the tubular carton form into the cavity 34. In a present embodiment, the open comers 62 are formed as partial-cylindrical passages traversing through each cavity 34 at the four comers.

Returning to the overall form, fill and seal machine 10 illustrated in FIG. 1, subsequent to positioning the tubular formed carton C within the cavity bar 26, the carton C is indexed to a next station at which the bottom panel score lines 64 are aligned with a bottom edge 66 of the cavity bar 26, e.g., bottom edge of the lower collar 48. Alignment is carried out by a bottom score line pusher 68 which can be actuated by, for example, a pneumatic cylinder 70, an electromechanical arrangement or the like.

Subsequent to aligning the bottom score line 64 with the bottom edge 66 of the cavity bar 26, the carton C is indexed to a bottom flap pre-fold or pre-break station 72. At the pre-break station 72, a vacuum can be applied about each of the cavities 34 on the cavity bar 26 so as to secure the carton C, by its outer periphery, to the inner periphery or surfaces 74 of the cavity 34. The vacuum is drawn by a vacuum pull assembly 76, in communication with a vacuum source V, that moves into engagement with each of the upper vacuum ports 58 on each of the upper collars 46. The vacuum is communicated to the lower collar 48 by the bore 59 extending through the support bar 36 and opening into the area above the lower collar 48.

Figure 4A:
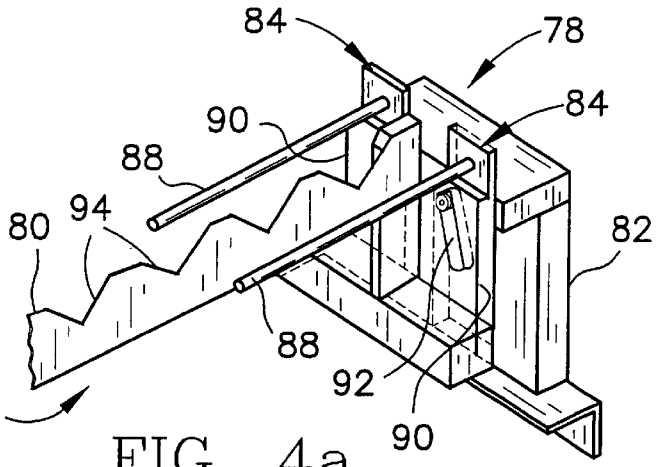
FIG. 4*a* is a partial perspective view of the bottom flap pre-break station and assembly, the assembly being illustrated with portions removed for clarity of illustration.
Figure 4B:
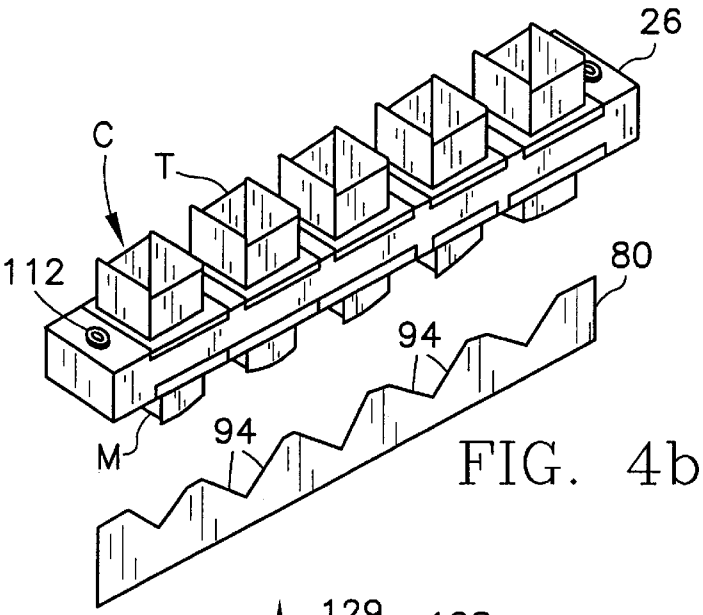
FIG. 4*b* is a partial perspective view of the assembly of FIG. 4*a,* illustrating the positional relationship between the breaker assembly and the cartons positioned within the cavity bar.

An exemplary bottom flap pre-break assembly 78 is illustrated in FIGS. 4*a* and 4*b*. The bottom flap pre-break assembly 78 includes a flap pre-breaker bar 80 that reciprocates so as to forcibly contact the bottom panels to fold the panels inwardly at their respective score lines 64.

The pre-break assembly 78 includes a stationary frame portion 82 that supports a cammed breaker bar assembly 84. The breaker bar assembly 84 includes the breaker bar 80 that is operably connected to a pair of transversely extending (relative to the direction of travel of the cartons C through the machine 10) aligning bars 88. The breaker assembly 78 is configured so that the aligning bars 88 are cammed to move upwardly/inwardly and downwardly/outwardly, during the pre-break stroke and release stroke, respectively, as driven by cammed rod supports 90. The rod supports 90 rotate about cam pins 92 (one shown), which provide the cammed movement. The breaker bar 80 and aligning bars 88 move vertically together, with the aligning bars 88 camming upwardly/inwardly during the upstroke (pre-break stroke) and downwardly/outwardly during the downstroke (release stroke).

The breaker bar 80 is formed having a plurality of serrated-like or waved, inclined surfaces 94 that contact the bottom flaps and urge the flaps inwardly, to pre-break, as the assembly 78 moves upwardly. With a vacuum established in each of the cavities 34 (i.e., a vacuum applied to the outer periphery of the carton C), the breaker bar 80 moves upward and the aligning bars 88 move upwardly/inwardly to center the carton C for the flap pre-break action. The vacuum applied to the carton C maintains the carton C in a relative, fixed position within the cavity bar 26 so that the carton C does not shift when engaged by the breaker bar 80.

Referring again to FIG. 1, after the carton C exits from the bottom flap pre-break station 72, it is indexed to a bottom panel heating station 96. At this station, a heater 98 is moved upward, into a position at about the bottom panels so as to heat the regions of the bottom panels for sealing. In a typical carton construction, a polymer coating is provided on the inner and outer surfaces of a paperboard or like core. The heater 98 subjects the bottom panels to an elevated temperature at which the polymeric coating softens so as to function as an adhesive to maintain the bottom flaps secured to one another to form the sealed carton bottom.

Figure 3:
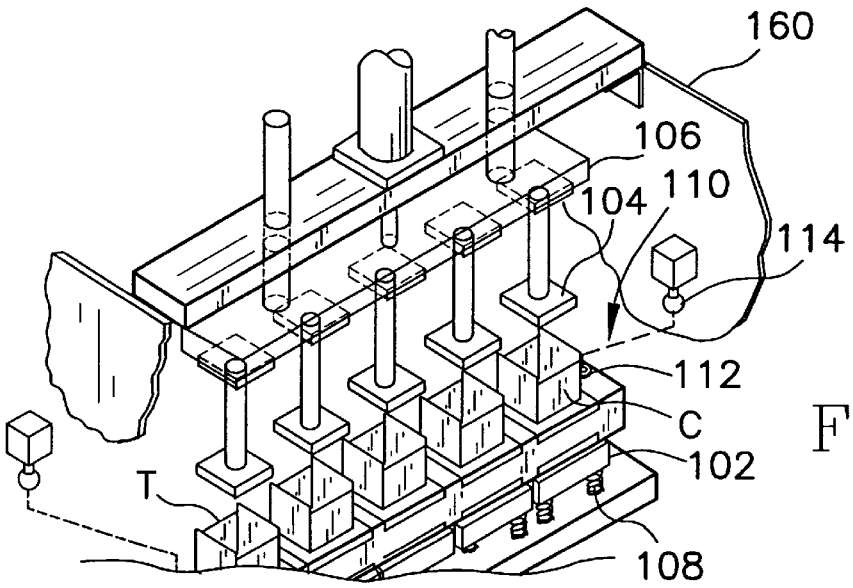
FIG. 3 is a partial perspective view of the carton bottom sealing station, showing the bottom flap presses or mandrels and anvil plates, and illustrating the shot ball and shot ball seat aligning arrangement.

The carton C is then indexed to a bottom sealing station 16. A rotating arm 100 engages the bottom trailing flap urging it forward quickly. The trailing flap is thus "tucked" under the bottom leading flap. Referring to FIGS. 1 and 3, the carton C continues to move to a position above an anvil 102 that is positioned at a bottom region of the carton C. A bottom flap press or mandrel 104 is moved in a reciprocating manner into the interior portion of the carton C so as to apply pressure to the bottom flaps, which are pressed between the mandrel 104 and the anvil 102, to seal the bottom flaps to one another. The mandrel 104 is a floating-type mandrel. That is, it is supported from about the top, and is allowed to align with the carton bottom as it moves into the carton to contact the bottom flaps. Supports 106, 108 are provided above the bottom flap mandrel 104 and below the anvil 102 so that an appropriate force can be applied to the carton bottom flaps to form the sealed bottom.

In order to assure alignment of the flaps for proper bottom sealing, each cavity bar 34 includes an alignment assembly 110 that is used at the bottom sealing station 16. In a preferred embodiment, as illustrated in FIG. 3, the alignment assembly 110 includes an opening 112 at about each end of the cavity bar 26 and a projection 114 that inserts into the opening to maintain the cavity 34 and the carton C, as it resides within the cavity 34, aligned with the bottom flap mandrel 104 and anvil 102.

In a current embodiment, the projection 114 is formed as a shot ball and the opening 112 in the cavity bar 26 is formed as a shot ball seat. The shot ball 114 inserts into the seat 112 to maintain the cavity bar 26 (and thus the carton C) aligned with the anvil 102 and mandrel 104. The shot ball 114 is positioned in or inserted into the seat 112 to restrain the cavity bar 26 at the proper position for insertion of the mandrel 104 into the carton C as it resides over the anvil 102.

As can be seen by from FIG. 1, at this point in time with the bottom flaps sealed, forming the sealed carton bottom, the carton C resides within the cavity bar 26 with the carton bottom essentially aligned with the bottom edge 66 of the cavity bar 26. To this end, the cartons C are next indexed to a carton top alignment station 116 at which a top flap pusher 118 contacts the open carton top to align the carton top score lines 120 with the top surface 122 of the cavity bar 26. In urging the cartons C to this aligned position, the carton bottoms are likewise aligned and the machine 10 can be configured so that the carton bottoms rest on a bottom plate 124.

Subsequent to carton top panel score line 120 alignment, the cartons C are moved to a filling station 18. Filling of the cartons C can be carried out in any of a variety of ways using a variety of methods as will be recognized by those skilled in the art. It is, however, anticipated that a gravity fill system may be used for filling the cartons C because the operating speed of the machine 10 may be commensurately reduced due to "parallel" package processing.

The cartons C are next indexed to a top flap pre-fold or pre-break station 126. At the top flap pre-break station 126, a pre-break assembly 128 moves in a reciprocating manner, downwardly, so as to contact and pre-break or pre-fold the carton top flaps at their respective score lines 120. Similar to the bottom flap pre-break station 72, a vacuum can be drawn on the cavity bar 26, by engagement of a vacuum pull assembly 130 with the upper collar vacuum port 58, to once again secure the carton side panels to the inner surfaces 74 of the cavity 34. Again, vacuum is communicated to the lower collar 48 through the bore 59 in the support bar 36 to provide vacuum at the lower collar 48/carton C interface. With the carton C secured within the cavity by vacuum, the top flap pre-break assembly 128 contacts the top flaps and in-folds the flaps to ready them for top flap sealing.

Figure 6:
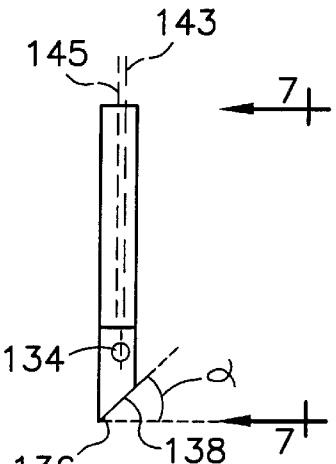
FIG. 6 is an enlarged side view of a breaker element of the top flap pre-break assembly.
Figure 7:
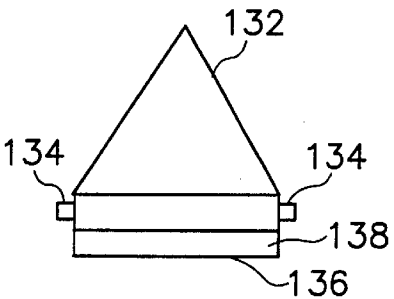
FIG. 7 is a front view of the breaker element taken along line 7—7 of FIG. 6.
Figure 5:
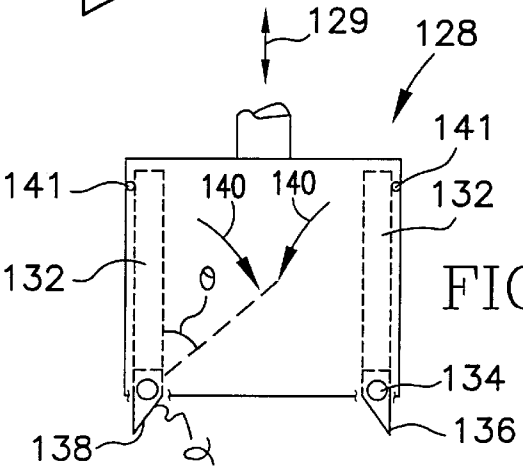
FIG. 5 is a partial side view of a top flap pre-break assembly.

In a preferred arrangement, the top flap pre-break assemblies 128, as illustrated in FIGS. 5–7, include a pair of pivoting breaker elements 132. The assemblies 128 reciprocate, in an upward and downward motion (as indicated by the double-headed arrow at 129), to engage the carton top flaps in the downward stroke and to disengage from the top flaps in the upward stroke. The breaker elements 132 pivot about a pair of pivot pins 134 located at the bottom near edges 136 of the breaker elements 132.

In an "at-rest" position, the elements 132 are oriented either vertically or slightly inwardly inclined so that the top flaps can be positioned between the elements 132. As the assemblies 128 begin to reciprocate downwardly, the elements 132 come into contact with the carton top flaps. With the assemblies 128 continuing their downward stroke, the breaker edges 136 contact the top surface 122 of the cavity bar 26. As can be seen in FIG. 5, the breaker edges 136 are formed having angled surfaces 138 formed at an angle a. As the assemblies 128 continue through the downward stroke, contact of the angled surfaces 138 with the cavity bar top surface 122 causes the breaker elements 132 to rotate inwardly (as indicated by the arrows at 140). As the breaker elements 132 rotate inwardly, the angled surface 138 is brought into full or flush contact with the top surface 122 and the elements 132 contact the top flaps to pre-fold or pre-break the carton C flaps into the folded position at about the score lines 120.

After the flaps are in-folded, the assemblies 128 begin to reciprocate upwardly to release the carton C. The breaker elements 132 can then reset to a vertical or inwardly inclined orientation in preparation for a next carton C. As stated above, the elements 132 can be oriented in either a vertical or a inwardly inclined orientation. This is to assure that the elements 132 rotate inwardly 140 as the edges 136 contact the cavity bar top surface 122. To prevent backward leaning of the elements, pins 141 can be positioned on the assemblies 128 to stop outward movement of the elements 132. Additionally, to facilitate inward rotation of the elements 132, the pivot pins 134 can be positioned off-centered, as indicated at 143 relative to a centerline 145 of the elements 132.

As with the bottom flap pre-breaker 78, a vacuum can be applied at the top flap pre-break station 126 to secure the cartons C within their respective cavities 34 and to urge the respective carton side panels into full contact with the inner walls 74 of their respective cavities 34. Thus, when the top flap pre-breaker 128 moves downwardly and into contact with the top flaps, the top flaps fold along their respective score lines 120, rather than collapsing the carton side panels.

As will be understood by those skilled in the art from a study of FIGS. 5 and 6, the angle $\alpha$ of the angled surfaces 138 can be formed at any desired angle to affect a desired angle of rotation $\theta$ (or pre-fold angle) of the elements 132. The geometric relationship between these angles is that they are equal to one another. That is, an angle $\alpha$ of 30 degrees relative to the horizontal will, when the angled surfaces 138 make full contact with the cavity bar top surface 122, cause the elements 132 to rotate through a rotation angle $\theta$ of 30 degrees relative to the vertical. Thus, a desired rotation angle $\theta$ (or pre-fold angle) can be obtained by proper configuration of the angle a of the angled surface 138.

Referring again to FIG. 1, the top flaps are then heated at a top flap heating station 142, much like that used for the bottom flaps. The heater 146, however, is stationary and the top flaps straddle the heater 146 as they are conveyed past the heater 146. The carton C is then moved into a top flap fold and press region 144 at which the top flaps are urged into engagement with one another, and, with the polymeric coating sufficiently heated to softness, the sealed top flap is formed. The cartons C are then moved along to a discharge station 22 where the cartons C are discharged or ejected from the apparatus 10, filled and sealed.

As set forth above, the machine 10 can include one or more stations at which the carton is sterilized, such as the exemplary sterilization station indicated at 24. For example, the cartons C can be sterilized after they are positioned within the cavities 34, prior to bottom flap folding so that the entirety of the carton C is sterilized, including those portions of the bottom panels that are in-folded to form the sealed carton bottom. Other locations for sterilization along the form, fill and seal machine 10 will be recognized and appreciated by those skilled in the art.

As is readily seen from FIG. 1, the machine 10 includes a belt or chain drive arrangement 148 on which the cavity bars 26 are mounted. The drive 148, which will be appreciated by those skilled in the art from a study of the figures and the above description, includes a conveying assembly, such as a belt or chain 150, on which the cavity bars 26 are mounted. As presented below, in a preferred embodiment, the cavity bars 26 are removably mounted to the belt or chain 150. The drive assembly 148 is configured so that the cavity bars 26 that return to the carton erection station 14 travel along a path, indicated at 152, that is spaced from and below the processing, e.g., packaging path, as indicated at 154. In this manner, the cavity bars 26 can be sterilized as they travel along this lower path 152 by, for example, an ionized spray of hydrogen peroxide, such as indicated at 158. Sterilization of the cartons C and/or the cavity bars can be carried out using hydrogen peroxide, ultraviolet sterilization or the like, or a combination of these techniques, or other known methods and applications.

In the illustrated embodiment of the packaging machine 10, the cavity bar 26 is shown with five cavities 34 positioned along the length of the bar 26. As will be appreciated by those skilled in the art, the bar 26 can be configured with a lesser or greater number of cavities 34, as is practicable and required for the particular machine configuration, depending upon the carton size and the throughput desired. In addition, as will be understood from the drawings and the above description, the various stations are each provided with an appropriate number of "tools", such as pre-break assemblies 78, 128, heaters 98, 146, filling assemblies and the like, so that a "tool" is associated with each carton C and each cavity 34 "line". To this end, in a preferred embodiment of the machine 10, the cavity bars 26 are removably mounted to the drive assembly 148 and the "tools" can be configured in a modular manner so that the machine 10 can be adapted for changing the size and number of cartons C at each station, while maintaining the overall length, height and width of the machine 10 constant.

As will also be appreciated by those skilled in the art, the "modularity" of the packaging machine 10 provides for processing a wide variety of carton sizes, i.e., cross-sections, as well as shapes. To this end, it is to be understood that the present packaging machine 10 can be used for packaging product into square, and non-square, rectangular cross-sectional cartons, as well as other, e.g., octagonal-shaped cartons.

In addition, because of the preferred modular manner of construction of the machine 10, the frame 156 of the machine 10 can be constructed around, and include side plates 160, as seen in FIGS. 1 and 3, within which and on which the various stations are mounted. This facilitates the modularity of the machine 10, while maintaining the drive assembly 148 overall size and configuration constant. The ability to utilize the side plates 160 as the principle support for the drive assembly 148 can also be used to facilitate the design of a hygienically controlled environment for the machine 10 for food processing.

The present packaging machine 10 includes various novel features that provide a number of advantages over known, conventional packaging machines. Aside from the advantages presented above, those skilled in the art will recognize that the present packaging machine 10 can provide increased throughput, by for example, forming, filling and sealing a plurality of cartons at a time. This "parallel" processing, as exemplified by the illustrated machine 10 which processes five cartons C at each station, increases the number of cartons operated on at any given station, thus increasing the machine throughput. Moreover, the novel design of the present packaging machine 10 can achieve this increased throughput with the same, or a decreased machine speed.

As will also be appreciated by those skilled in the art, although the present form, fill and seal machine has been described with reference to the application of a vacuum to maintain the cartons in proper position at various stations of the machine, the present cavity bar arrangement can also be used with more conventional, mandrel-type configurations. The use of conventional mandrels for supporting the cartons during erection is within the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A form, fill and seal packaging machine adapted to receive a carton blank having top flaps and bottom flaps, erect the carton blank into an open-top carton, fill and seal the open-top carton, each carton having a predetermined cross-sectional shape and size, the machine comprising:

a frame;

means for erecting the carton blank into an open-top carton;

means for sealing bottom flaps of the open-top carton to form a sealed bottom;

means for filling the open-top carton;

means for sealing top flaps of the open-top carton;

a drive assembly;

a conveying assembly operably connected to the drive assembly for moving the cartons through the form, fill and seal packaging machine;

a plurality of cavity bars carried by the conveying assembly, each of the cavity bars defining at least one cavity formed therein corresponding generally to the cross-sectional size and shape of the cartons, each of the cavities being defined by internal peripheral walls having a contiguous periphery, the cavity being configured to receive and support the carton as the carton is conveyed through the form, fill and seal packaging machine;

said cavity bar comprises a collar portion having a cabity matching the cavity of the cavity bar; and the internl peripheral walls of said cavities in said bar and collar portion define a plurality of vacuum and vacuum legs with each of said legs having walls in both the cavities of said bar and said collar portion.

2. The form, fill and seal packaging machine in accordance with claim 1 wherein the said vacuum openings adapted to engage a carton disposed in the cavity to secure the carton to the internal peripheral walls by application of a vacuum through the vacuum openings, and wherein the vacuum is applied to the carton to secure the carton within the cavity.

3. The form, fill and seal packaging machine in accordance with claim 2 wherein the cavity bar is formed having a collar channel and wherein said collar portion fits within the collar channel having a cavity matching the cavity in the cavity bar.

4. The form, fill and seal packaging machine in accordance with claim 3 wherein the cavity bar is formed having collar channels formed in upper and lower surfaces thereof, and wherein the cavity bar includes a collar portion fitted within each of the collar channels, the collar portions having a cavity matching the cavity in the cavity bar.

5. The form, fill and seal packaging machine in accordance with claim 3 wherein the collar portion defines a vacuum channel for communicating the vacuum from a vacuum source to the carton.

6. The form, fill and seal packaging machine in accordance with claim 5 wherein the vacuum channel includes a peripheral portion and a plurality of vacuum legs extending from the peripheral portion to openings in the collar portion.

7. The form, fill and seal packaging machine in accordance with claim 6 wherein the cavity bar includes a body and wherein the collar channels are formed in the body and wherein openings are formed in the body corresponding to the openings in the collar portion.

8. The form, fill and seal packaging machine in accordance with claim 5 wherein the collar portion includes a vacuum port formed therein for communicating the vacuum from the vacuum source to the collar portion.

9. The form, fill and seal packaging machine in accordance with claim 2 including a bottom flap pre-folding station, and including a vacuum supply member configured to communicate the vacuum to the cavity at about the bottom flap pre-folding station.

10. The form, fill and seal packaging machine in accordance with claim 2 including a top flap pre-folding station, and including a vacuum supply member configured to communicate the vacuum to the cavity at about the top flap pre-folding station.

11. The form, fill and seal packaging machine in accordance with claim 1 wherein each cavity defines a plurality of comers and wherein each comer defines an indentation into the comer of the cavity forming a gap between an exterior surface of the carton at the corner and the internal peripheral wall of the cavity adjacent the carton at the corner.

12. A form, fill and seal packaging machine adapted to receive a carton blank, erect the carton blank into an open-top carton, fill and seal the open-top carton, each carton having a predetermined cross-sectional shape and size, the machine comprising:

a frame including means for forming a package;

a drive assembly;

a conveying assembly operably connected to the drive assembly for moving the cartons through the machine through a predetermined path;

a plurality of cavity bars carried by the conveying assembly, each of the cavity bars being a rigid member and defining at least two cavities formed therein corresponding generally to the cross-sectional size and shape of the cartons, each of the cavities having a contiguous internal surface and an open top and bottom, and configured to secure the carton therein as the carton is conveyed along the predetermined path;

said cavity bar comprises a collar portion having a cavity matching the cavity of the cavity bar; and the internal peripheral walls of said cavities in said bar and collar portion define a plurality of vacuum openings and vacuum legs with each of said legs having walls in both the cavities of said bar and said collar portion.

13. The form, fill and seal packaging machine in accordance with claim 12 wherein the internal surface has a plurality of vacuum openings formed therein adapted to engage the carton disposed in the respective cavities to secure the cartons within the cavities by application of a vacuum through the vacuum openings, and wherein the vacuum is applied to the cartons at at least a portion of the predetermined path to secure the cartons within the cavities.

14. The form, fill and seal packaging machine in accordance with claim 13 wherein the wherein the cavity bar is formed having collar channels formed in upper and lower surfaces thereof, and wherein the cavity bar includes a collar portion fitted within each of the collar channels, the collar portions each having a cavity matching the cavity in the cavity bar.

15. The form, fill and seal packaging machine in accordance with claim 14 wherein the collar portions each define a vacuum channel for communicating the vacuum from a vacuum source to the carton, and wherein the upper collar portions include vacuum ports on an external surface thereof for communicating the vacuum to the vacuum openings.

16. The form, fill and seal packaging machine in accordance with claim 15 wherein the vacuum channels each include a peripheral portion and a plurality of vacuum legs extending from the respective peripheral portions to openings in the collar portions.

17. The form, fill and seal packaging machine in accordance with claim 15 wherein the cavity bar includes a body having the collar channels formed therein and wherein openings are formed in the body corresponding to the openings in the collar portion.

18. The form, fill and seal packaging machine in accordance with claim 12 wherein each cavity defines a plurality of corners and wherein each of the corners defines an indentation into the corner of the cavity forming a gap between an exterior surface of the carton at the corner and the internal peripheral wall of the cavity adjacent the carton at the corner.

19. The form, fill and seal packaging machine in accordance with claim 15 including a bottom flap pre-folder, and including a vacuum supply member configured to communicate the vacuum to the cavity at about the bottom flap pre-folder.

20. The form, fill and seal packaging machine in accordance with claim 15 including a top flap pre-folder, and including a vacuum supply member configured to communicate the vacuum to the cavity at about the top flap pre-folder.

21. The form, fill and seal packaging machine in accordance with claim 12 wherein the conveying assembly has a predetermined path having an upper, generally horizontal path portion and a lower path portion, and wherein the lower path portion is spaced from the upper path portion.

22. The form, fill and seal packaging machine in accordance with claim 21 wherein the conveying assembly includes a generally vertical path portion, and wherein a partially-formed carton is urged into the cavity as the cavity bar traverses along the generally vertical path portion.

23. A form, fill and seal packaging machine adapted to receive a carton blank, erect the carton blank into an open-top carton, fill and seal the open-top carton, each carton having a predetermined cross-sectional shape and size, the machine comprising:

a frame;

a plurality of stations carried by the frame including a carton erection station, a bottom flap pre-folding station and a bottom flap sealing station, a filling station, a top flap pre-folding station and a top flap sealing station;

a drive assembly;

a conveying assembly operably connected to the drive assembly for moving the cartons through the stations;

a plurality of cavity bars carried by the conveying assembly, each of the cavity bars being a rigid member and defining at least two cavities formed therein corresponding generally to the cross-sectional size and shape of the cartons, each of the cavities being defined by contiguous internal peripheral surfaces, and open top and an open bottom and upper and lower channels, the channels having a collar portion fitted within each of the channels, each collar portion having a cavity matching the cavity in the cavity bar, the collars and the internal peripheral surfaces having a plurality of vacuum openings formed therein adapted to engage a carton disposed in the cavity to secure the carton to the internal peripheral surfaces by application of a vacuum through the vacuum openings, wherein the vacuum is applied to the cartons at at least one of the stations to secure the carton within the cavity;

said cavity bar comprises a collar portion having a cavity matching the cavity of the cavity bar; and the internal peripheral walls of said cavities in said bar and collar portion define a plurality of vacuum openings and vacuum legs with each of said legs having walls in both the cavities of said bar and said collar portion.

24. The form, fill and seal packaging machine in accordance with claim 23 wherein the collar portions each define a vacuum channel for communicating the vacuum from a vacuum source to the vacuum openings.

25. The form, fill and seal packaging machine in accordance with claim 24 wherein the vacuum channel includes a peripheral portion and a plurality of vacuum legs extending from the peripheral portion to the vacuum openings.

26. The form, fill and seal packaging machine in accordance with claim 24 wherein the collar portions include a vacuum port formed therein for communicating the vacuum from the vacuum source to the vacuum openings.

27. The form, fill and seal packaging machine in accordance with claim 23 including a vacuum supply member configured to communicate the vacuum to the cavity bar at about the bottom flap pre-folding station.

28. The form, fill and seal packaging machine in accordance with claim 23 including a vacuum supply member configured to communicate the vacuum to the cavity bar at about the top flap pre-folding station.

29. The form, fill and seal packaging machine in accordance with claim 23 wherein the conveying assembly has a predetermined path having an upper, generally horizontal path portion and a lower path portion, and wherein the lower path portion is spaced from the upper path portion.

30. The form, fill and seal packaging machine in accordance with claim 29 wherein the conveying assembly includes a generally vertical path portion, and wherein a partially-formed carton is urged into the cavity as the cavity bar traverses along the generally vertical path portion.

31. The form, fill and seal packaging machine in accordance with claim 23 wherein each cavity defines a plurality of corners and wherein each corner defines an indentation into the corner of the cavity forming a gap between an exterior surface of the carton at the corner and the internal peripheral wall of the cavity adjacent the carton at the corner

32. A cavity bar for use in a form, fill and seal packaging machine adapted to receive a carton blank, erect the carton blank into an open-top carton, fill and seal the open-top carton, each carton having a predetermined cross-sectional shape and size, the cavity bar comprising:

a rigid support portion defining at least two cavities formed therein corresponding generally to the cross-sectional size and shape of the cartons, each of the cavities being defined by contiguous internal peripheral surfaces, an open top and an open bottom, the support portion defining at least one channel having an insert portion fitted within each of the at least one channel, the insert having a cavity matching the cavity in the support portion, the insert and the internal peripheral surfaces having vacuum openings formed therein adapted to engage a carton disposed in the cavity to secure the carton to the internal peripheral surfaces by application of a vacuum through the vacuum openings.

said internal peripheral walls of said cavities in said bar and insert portion define a plurality of vacuum openings and vacuum legs with each of said legs having walls in both the cavities of said bar and said collar portion.

33. The cavity bar in accordance with claim 32 including upper and lower channels formed therein at each of the cavities, wherein each of the channels is fitted with an insert.

34. The cavity bar in accordance with claim 33 wherein the inserts each define a vacuum channel for communicating a vacuum from a vacuum source to the vacuum openings.

35. The cavity bar in accordance with claim 34 wherein the vacuum channel includes a peripheral portion and a plurality of vacuum legs extending from the peripheral portion to the vacuum openings.

36. The cavity bar in accordance with claim 34 wherein the inserts each include a vacuum port formed therein for communicating the vacuum from the vacuum source to the vacuum channel.

37. The cavity bar i accordance with claim 32 wherein each cavity defines a plurality of corners and wherein each corner defines an indentation into the corner of the cavity forming a gap between an exterior surface of the carton at the corner and the internal peripheral wall of the cavity adjacent the carton at the corner.

* * * * *